US006910471B2

(12) United States Patent
Deibert et al.

(10) Patent No.: US 6,910,471 B2
(45) Date of Patent: Jun. 28, 2005

(54) METHOD FOR DETERMINING THE FUEL/AIR RATIO IN THE INDIVIDUAL CYLINDERS OF A MULTI-CYLINDER INTERNAL COMBUSTION ENGINE

(75) Inventors: Ruediger Deibert, Esslingen (DE); Johannes Kanters, Stuttgart (DE); Johann Riegel, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 137 days.

(21) Appl. No.: 10/363,072

(22) PCT Filed: Jun. 1, 2002

(86) PCT No.: PCT/DE02/02013

§ 371 (c)(1),
(2), (4) Date: Aug. 1, 2003

(87) PCT Pub. No.: WO03/004850

PCT Pub. Date: Jan. 16, 2003

(65) Prior Publication Data

US 2004/0024519 A1 Feb. 5, 2004

(30) Foreign Application Priority Data

Jun. 29, 2001 (DE) ..... 101 31 179

(51) Int. Cl.[7] ..... F02D 41/14
(52) U.S. Cl. ..... 123/673; 73/118.1; 60/323
(58) Field of Search ..... 123/673; 701/109; 60/276, 323; 73/118.1, 23.32

(56) References Cited

U.S. PATENT DOCUMENTS 4,745,742 A 5/1988 Nada et al.
5,535,135 A 7/1996 Markyvech et al.
5,813,389 A 9/1998 Kitamura et al.
6,082,103 A * 7/2000 Sugiura et al. ..... 60/323
6,148,808 A 11/2000 Kainz
6,382,198 B1 * 5/2002 Smith et al. ..... 123/673
6,823,839 B2 * 11/2004 Yasui et al. ..... 123/339.12

FOREIGN PATENT DOCUMENTS

WO WO 99 36690 7/1999

OTHER PUBLICATIONS

Moraal et al., *Single Sensor Individual Cylinder Air–Fuel Ratio Control of an Eight Cylinder Engine With Exhaust Gas Mixing*, Proc. of the American Control Conf., San Francisco, Jun. 2–4, 1993.*

Hasegawa et al., *Individual Cylinder Air–Fuel Ratio Feedback Control Using an Observer*, SAE Paper 940376,International Congress & Exposition, Detroit, MI, Feb. 28–Mar. 3, 1994.**

* cited by examiner

*Primary Examiner*—Hai Huynh
(74) *Attorney, Agent, or Firm*—Kenyon & Kenyon

(57) ABSTRACT

A method is presented for determining the fuel/air ratio in the individual cylinders (single cylinder lambda) of an internal combustion engine having a plurality of cylinders, whose exhaust gases mix together in a common exhaust gas pipe system, from the signal of an exhaust gas probe, whose mounting location lies in the common exhaust gas pipe system, with the aid of an invertible model for the intermixing of the exhaust gases at the mounting location of the exhaust gas probe. The method is distinguished in that, in the determination of the single cylinder lambda from the signal of the one exhaust gas probe evaluated with the aid of the inverted model, the rotational angle position of the exhaust gas probe at its mounting position is taken into consideration.

5 Claims, 3 Drawing Sheets

METHOD FOR DETERMINING THE FUEL/AIR RATIO IN THE INDIVIDUAL CYLINDERS OF A MULTI-CYLINDER INTERNAL COMBUSTION ENGINE

FIELD OF THE INVENTION

The present invention relates to a method for determining the fuel/air ratio in the individual cylinders (single cylinder lambda) of an internal combustion engine having a plurality of cylinders, whose exhaust gases mix together in a common exhaust gas pipe system, from the signal of an exhaust gas probe, whose mounting location lies in the common exhaust gas pipe system, with the aid of an invertible model for the intermixing of the exhaust gases at the mounting location of the exhaust gas probe.

BACKGROUND INFORMATION

SAE Paper 940376 describes a type of fuel/air ratio determining method. During the determination of a single cylinder lambda from the signal of the one exhaust gas probe evaluated with the aid of an inverted model, it has been shown in test stand experiments that there was good agreement of the results of the model and the actual values of lambda that occurred in the individual cylinders. However, when the model applied to one engine using a reference probe was transferred to other engines of the same type, greater deviations between the modeled lambda values and the measured lambda values showed up. In this context, faulty assignments were also noted. That means, the model did appear to deliver appropriate lambda values, but it associated these with the wrong cylinders.

SUMMARY OF THE INVENTION

In view of this, the object of the present invention is to state an improved method for determining single cylinder lambda values from the signal of an exhaust gas probe which is situated behind a location in the exhaust gas system at which the exhaust gases of the various cylinders flow together.

This object is attained by a method of the type named at the beginning in that, during the determination of the single cylinder lambda from the signal of the one exhaust gas probe evaluated with the aid of the inverted model, the rotational angle position of the exhaust gas probe at its mounting position is taken into consideration.

In an advantageous manner, this measure makes possible the compensation of the influence of unknown probe mounting angles by a control unit function. One can then do without fixing the probe mounting angle by mechanical devices that would otherwise be necessary. This permits the cost-effective production of exhaust gas probes as well as the exhaust gas systems into which the exhaust gas probes are screwed.

A further measure provides that at least one cylinder of the internal combustion engine is temporarily operated using a fuel/air mixture composition, which deviates from the fuel/air mixture composition of the remaining cylinders in a predefined manner; that the reaction of the exhaust gas probe is ascertained for this deviation and a comparison is made to at least one stored reaction which was recorded under equal conditions using an exhaust gas probe whose rotational angle position was known at its mounting location; and that the further processing of the probe signal was influenced in such a way that the predefined deviation is reproduced by the estimated values formed by the model.

This measure gives the advantage of a test function that is easy to implement for ascertaining the unknown probe angle.

A further measure provides that the reaction of the exhaust gas probe is compared for the said deviation with several stored reactions, which in each case were recorded using another, known rotational angle position of the exhaust gas probe at otherwise the same conditions; that the particular one of the stored reactions is selected, which has the greatest similarity to the signal of the exhaust gas probe; and that the further processing of the probe signal is influenced by the fact that the estimated values will in the future be formed by a model which was adjusted to the selected reaction.

This measure gives the advantage of a very accurate adjustment of the model to the probe's mounting angle.

Another measure provides that the further processing of the probe signal is influenced in that the input signal of the model's signal corresponds to the phase-shifted signal of the exhaust gas probe; and that the extent of the phase-shifting is changed until the reaction of the exhaust gas probe corresponds to a certain stored reaction.

This measure requires particularly little storage space and calculating capacity, because it takes effect in the signal processing chain, so to speak, before the more painstaking calculations of the model.

Yet another measure provides that the further processing of the probe signal is influenced by the fact that the signal of the exhaust gas probe is sampled, synchronously as to rotational speed, in such a way that for each ignition top dead center of each cylinder a sampled value is present; and that the position of the sampling point in time is varied relative to the ignition top dead center until the reaction of the exhaust gas probe corresponds to a certain stored reaction.

Here, too, it is true that this measure requires particularly little storage space and calculating capacity, because it takes effect in the signal processing chain, so to speak, before the more painstaking calculations of the model.

DETAILED DESCRIPTION

Figure 1:
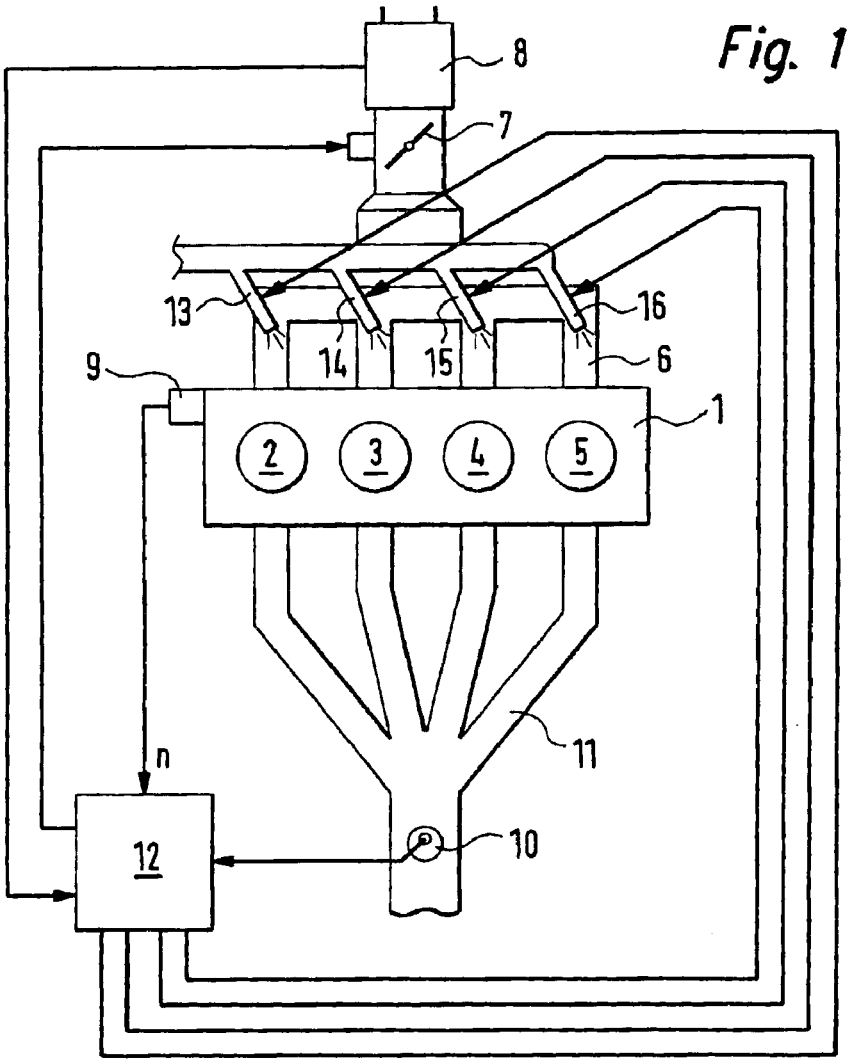
FIG. 1 shows a technical environment in which the present invention comes into use.

Numeral 1 in FIG. 1 represents an internal combustion engine having four cylinders 2, 3, 4 and 5. The cylinders are supplied with air or fuel/air mixture by an intake manifold 6. The quantity of air drawn in by the cylinders is controlled by an air quantity control element 7, for instance, a throttle valve. Alternatively, the quantity of air flowing into the cylinders may also be controlled by a variable valve timing. An air quantity meter 8 measures the quantity of the air drawn in by the internal combustion engine. The rotational speed n of the internal combustion engine is recorded by a rotational speed sensor 9. An exhaust gas sensor 10 is used to record the ratio of fuel to air, and it is situated in an exhaust gas system 11 at a mounting location which, as viewed in the direction of the exhaust gas flow, lies behind the confluence of the exhaust gases of the individual cylinders to form an overall exhaust gas flow. From measured operating parameters of the internal combustion engine, at least from the measured air quantity and the rotational speed, a control unit calculates a measure for the charge of the individual cylinders with air, and to accomplish this, it forms injection pulse widths ti for activating fuel injectors 13, 14, 15 and 16 that are individual to each cylinder. The fuel injectors are able to inject the fuel, for example, before the intake valves of the cylinders or directly into the combustion chambers of the cylinders. The fuel metering may be checked by the signal of the exhaust gas sensor, and corrected, if necessary, by control unit 12.

At the mounting location of the exhaust gas probe, a thorough mixing of the exhaust gases of the cylinders has already taken place. Therefore, the composition of the exhaust gas at the mounting location of the probe is a function of the lambda values of the individual cylinders. The lambda values of the individual cylinders may be constructed in the following manner, in a simplified representation. The signal of the exhaust gas probe is sampled in the individual cylinders synchronously with the points in time of the ignition. At a point t, the exhaust gas composition at the probe mounting location, for example, is determined for the greater part by the composition of the exhaust gas of the last combustion and for respectively lesser parts by the exhaust gas composition of the preceding combustions. Thus, each cylinder influences the exhaust gas composition at point t, at a certain weight c. Expressed in a different way:

The lambda value measured at the mounting location of the probe may be represented by the sum of the actual lambda values furnished with weighting factors c.

Thus, for an internal combustion engine having N cylinders, in the case of ignition-synchronous sampling, this results in N measured lambda values which may be associated with the N actual values of lambda via a weighting factor matrix cij having N rows and N columns.

The weighting factors may be ascertained by test stand measurements. The ascertained weighting factors thereby represent, as it were, the parameters of a model by the use of which, in the opposite direction, lambda estimated values for the individual cylinder lambda values may be ascertained from N sampling values of the probe signal in each case. The opposite direction thus corresponds to the inverted model.

Details on this, as well as details on a single cylinder lambda regulation based on this, may be seen in the above-mentioned SAE paper.

Exhaust gas probes are usually screwed into the exhaust system and are thereby set tightly, mechanically into the exhaust system. If several combinations of exhaust gas probes of like construction and exhaust gas systems of like construction are screw fitted with one another, the rotational angle at which a sufficiently great bracing occurs is different from combination to combination.

The inventors have found that the dispersions in the estimated values of lambda determined in the manner described above correlate to the rotational position of the exhaust gas probe. It is possible that failure in the rotational symmetry in the exhaust gas probe structure is responsible for this. Thus, for example, the gas-sensitive part of an exhaust gas sensor may be platelet-shaped, and therefore not rotationally symmetrical. Besides that, the gas-sensitive region of an exhaust gas probe is usually surrounded by a protective tube which has openings for passage of the gas. Depending on the rotational position of the openings and of the gas-sensitive part, there may possibly be delays in the time that passes between the ejection of the exhaust gas from the cylinder and its arrival at the gas-sensitive part of the exhaust gas probe. Even in the case of a rotationally symmetrical, gas-sensitive probe part, asymmetries in the heating of the sensor may possibly be responsible for the fact that an asymmetrical temperature distribution favors the functioning of subsections of the gas-sensitive part, so that its rotational angle position may fluctuate from component combination to component combination.

Figure 2:
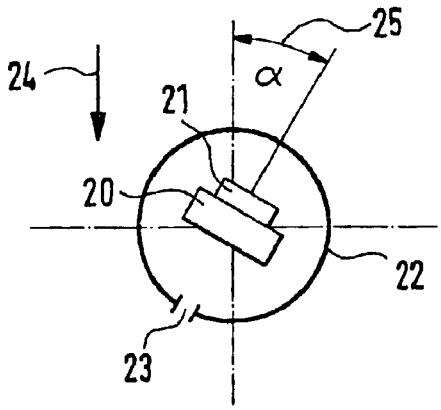
FIG. 2 represents a schematic illustration of an exhaust gas probe 10 having a section that is taken in a plane perpendicular to the screw-in axis.

FIG. 2 makes clear these interrelationships by a schematic representation of an exhaust gas probe 10, which is sectioned in the plane perpendicular to the axis of its being screwed in. Numeral 20 denotes a carrier structure which carries a gas-sensitive part 21. Numeral 22 denotes a protective tube which surrounds the gas-sensitive part and has openings 23 to the exhaust gas system. Arrow 24 makes clear the flow direction of the exhaust gas, and arrow 25 denotes the angle alpha, by which the gas-sensitive part is rotated with respect to the flow direction of the exhaust gas.

Figure 3:
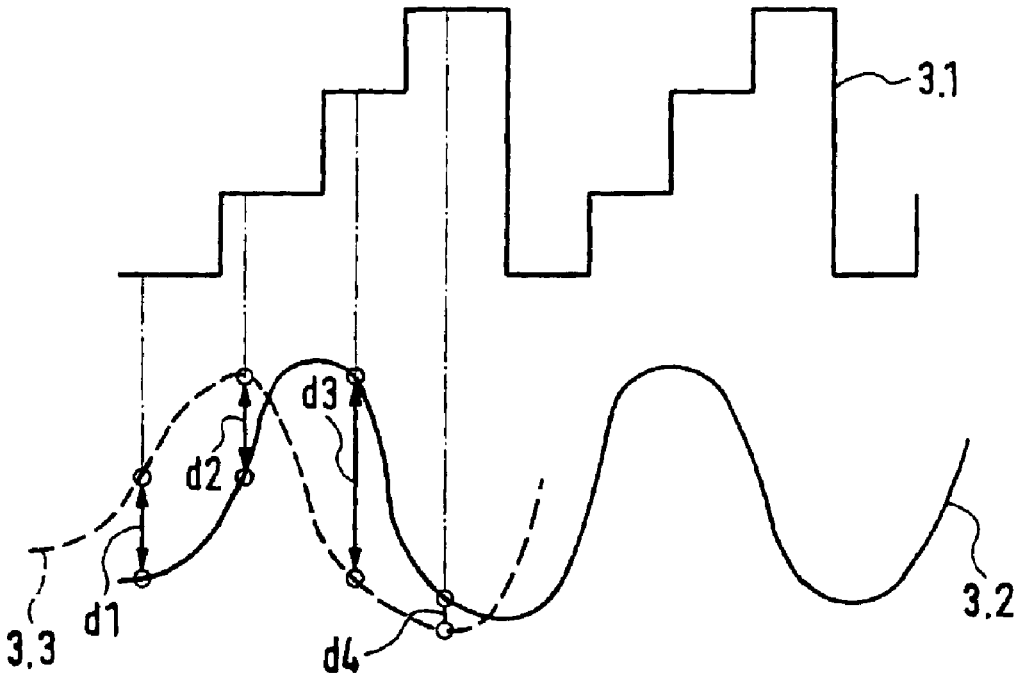
FIG. 3 makes clear the formation of input signals for the model for estimating the actual values of lambda.
Figure 4:
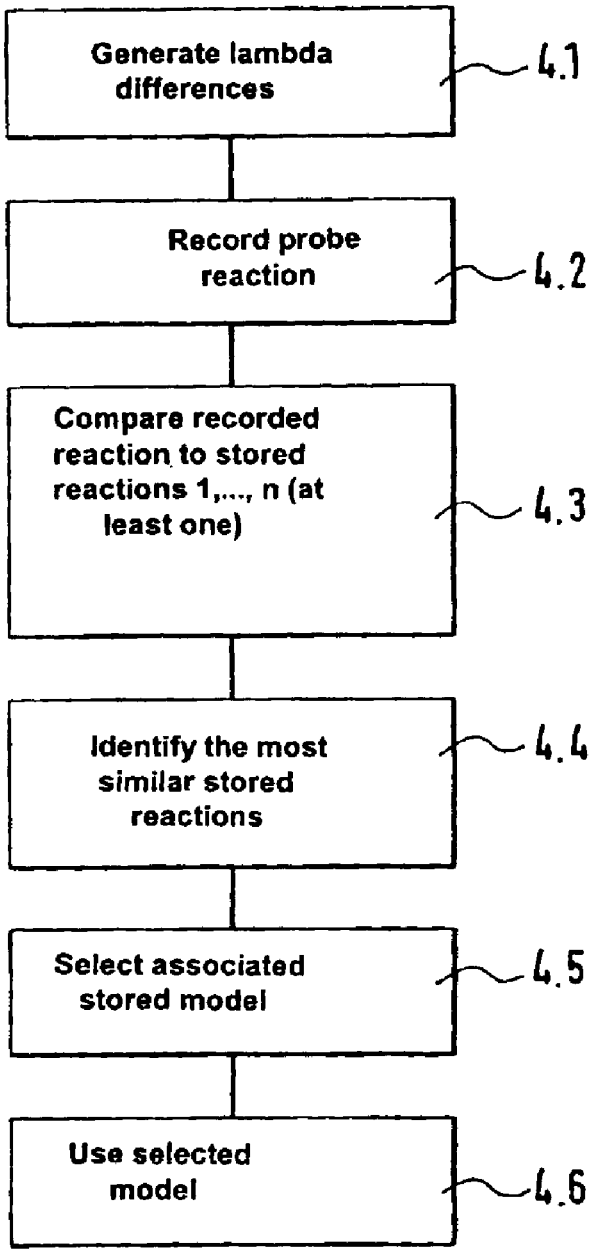
FIG. 4 shows a flow diagram as an exemplary embodiment of a method according to the present invention.

FIG. 3 makes clear the formation of input signals for the model for estimating the actual lambda values. Signal 3.1 represents a counter reading which, for example, is advanced at each top dead center of a cylinder after the compression cycle (ignition top dead center) and which, in each case, after a working cycle, i.e. after the internal combustion engine has once run through the ignition top dead center of all the cylinders, is set to zero. Signal 3.2 represents an exhaust gas probe signal oscillating synchronously with it. This special pattern comes about, for instance, when one of the cylinders is operated with a fuel/air mixture composition which deviates from the fuel/air mixture composition of the other cylinders. If, for example, the mixture in this cylinder is richer than that of the other cylinders, there appears one rich pulse per working cycle in the signal of the exhaust gas probe, as in signal 3.2. The signal of the exhaust gas probe is sampled at predefined distances from the individual ignition top dead centers, so that, per working cycle of the internal combustion engine, N sampling values result, N being the number of cylinders. It has been shown that a rotation of the probe leads to changes in the exhaust probe signal, such as to phase shifts. Line 3.3 represents such a phase-shifted exhaust gas probe signal. It may be seen in the drawing that the values of signals 3.2 and 3.3 sampled at a certain point in time are greatly different. The differences are represented by arrows d1 through d4. This makes it clear that further processing of these greatly different sampled values, without correction of the same model, leads to estimated values for the actual lambda values of the individual cylinders which, in an undesired way, are functions of the angle of mounting of the exhaust gas probe. FIG. 4 shows a flow diagram as exemplary embodiment of a method according to the present invention which removes this dependency, or at least reduces it.

In step 4.1, for this purpose, differences between the actual lambda values of the individual cylinders are generated. To do this, for example, within the framework of a temporary test function operation, one cylinder may be operated in rich operation and the other cylinders in lean operation. Parallel to this, during the test function operation, the exhaust gas probe signal is sampled in connection with the manner described in FIG. 3. This recording of the exhaust gas probe reaction is represented by step 4.2. In step 4.3 there takes place a comparison of the recorded probe reaction to various stored probe reactions, of which each was recorded at a known mounting angle. The sum of the absolute values of the distances between sampling values corresponding to the lengths of arrows d1, d2, d3, d4 in FIG. 3 may be used as the criterion for comparison. In step 4.4 that stored probe reaction is identified which has the greatest similarity to the recorded probe reaction. This may be, for example, the stored probe reaction having the smallest value of the above-mentioned sum. Since this stored probe reaction belongs with a certain known probe mounting angle, the information concerning the probe mounting angle flows in at this point of the method. The similarity of the sampling values is interpreted to mean that the probe mounting angle, unknown up to this point, corresponds to the stored probe mounting angle identified in the manner described. In one of the exemplary embodiments of the present invention various models are stored in control unit 8, or rather sets of model parameters (e.g. matrix elements cij). In step 4.5 the model associated with the identified probe mounting angle is selected. Step 4.6 represents the processing of the sampled probe signal values, using the selected model, which takes place subsequently.

As an alternative to the step sequence 4.3 through 4.6 described, one may also carry out a comparison of the recorded probe reactions using a single stored probe reaction. In this case the further processing of the probe signal is influenced in that the phase shift is formed between the stored reaction and the recorded reaction, and in that the input signal of the model's signal corresponds to the phase-shifted signal of the exhaust gas probe. The extent of the phase shift may be ascertained, for example, in that first an arbitrarily assumed phase shift of the model's input signal is changed until the reaction of the exhaust gas probe corresponds to a certain stored reaction.

As a further alternative, the further processing of the probe signal is influenced in that the signal of the exhaust gas probe is sampled, synchronously as to rotational speed, in such a way that for each ignition top dead center of each cylinder a sampled value is present; and that the position of the sampling point in time is varied relative to the ignition top dead center until the reaction of the exhaust gas probe corresponds to a certain stored reaction.

This alternative may also be combined with the exemplary embodiment described above, in which various probe reactions are used which appertain to various probe mounting angles. For reasons concerning the cost of the application and the requirement for storage space, the angular resolution of this method is limited. Let us assume, for example, that the models for four different probe mounting angles were applied, for instance 90°, 180°, 270° and 360°. Then, in a first step, the stored angle may be assigned that is closest to the real probe mounting angle. The remainder of the deviation may then be compensated for, using the method of phase shift or the method of the variation of the sampling points in time.

What is claimed is:

1. A method for determining a fuel/air ratio in individual cylinders (single cylinder lambda) of an internal combustion engine having a plurality of cylinders, whose exhaust gases mix together in a common exhaust gas pipe system, from a signal of an exhaust gas probe, a mounting location of the exhaust gas probe lying in the common exhaust gas pipe system, with the aid of an invertible model for an intermixing of the exhaust gases at the mounting location of the exhaust gas probe, comprising:

determining the single cylinder lambda from the signal of the exhaust gas probe evaluated with the aid of the invertible model in accordance with a rotational angle position of the exhaust gas probe at the mounting position thereof.

2. The method as recited in claim 1, further comprising:

temporarily operating at least one cylinder of the internal combustion engine in accordance with a flue/air mixture composition that deviates from a fuel/air mixture composition of remaining ones of the cylinders according to a predefined deviation;

ascertaining a reaction of the exhaust gas probe for the deviation;

performing a comparison to at least one stored reaction that was recorded under equal conditions using the exhaust gas probe at another rotational angle position at the mounting location thereof; and influencing a further processing of the signal of the exhaust gas probe such that the predefined deviation is reproduced by estimated values formed by the invertible model.

3. The method as recited in claim 2, further comprising:

comparing the reaction of the exhaust gas probe for the predefined deviation with the at least one stored reaction, each of the at least one stored reaction being recorded using the other rotational angle position of the exhaust gas probe at otherwise the same conditions; and selecting that of the at least one stored reaction that has the greatest similarity to the signal of the exhaust gas probe, wherein:

the further processing of the signal of the exhaust gas probe is influenced in that the estimated values will in the future be formed by a model which was adjusted to the selected reaction.

4. The method as recited in claim 2, wherein:

the further processing of the signal of the exhaust gas probe is influenced in that an input signal of a signal of the invertible model corresponds to a phase-shifted signal of the exhaust gas probe, and an extent of the phase-shift is changed until the reaction of the exhaust gas probe corresponds to the at least one stored reaction.

5. The method as recited in claim 2, wherein:

the further processing of the signal of the exhaust gas probe is influenced in that the signal of the exhaust gas probe is sampled, synchronously as to rotational speed, in such a way that for each ignition top dead center of each cylinder a sampled value is present, and a position of a sampling point in time is varied relative to the at least one stored reaction.

* * * * *